US006550165B2

(12) United States Patent
Chirafesi, Jr.

(10) Patent No.: US 6,550,165 B2
(45) Date of Patent: Apr. 22, 2003

(54) PERPETUAL CALENDAR WALL DISPLAY DEVICE HAVING ROTATABLE CALENDAR DAYS

(76) Inventor: Charles Chirafesi, Jr., 732 Ercama St., Linden, NJ (US) 07036-5726

( * ) Notice: Subject to any disclaimer, the term of this patent is extended or adjusted under 35 U.S.C. 154(b) by 0 days.

(21) Appl. No.: 09/951,530

(22) Filed: Sep. 14, 2001

(65) Prior Publication Data

US 2003/0051377 A1 Mar. 20, 2003

(51) Int. Cl.[7] ..... G09D 3/08

(52) U.S. Cl. ..... 40/113; 40/111; 40/107; 283/2

(58) Field of Search ..... 40/113, 111, 107, 40/114, 115; 283/2

(56) References Cited

U.S. PATENT DOCUMENTS

| | | | | | |
|---|---|---|---|---|---|
| 101,333 | A | * | 3/1870 | Wight | 40/111 |
| 166,796 | A | * | 8/1875 | Miller | 40/107 |
| 247,000 | A | * | 9/1881 | Bath | 40/107 |
| 301,553 | A | * | 7/1884 | Bereman | 40/109 |
| 2,110,668 | A | * | 3/1938 | Janssen | 40/111 |
| 2,400,268 | A | * | 5/1946 | Skene | 40/107 |
| 3,765,111 | A | * | 10/1973 | Spicer | 40/111 |
| 4,075,774 | A | * | 2/1978 | Day | 40/109 |
| 4,216,596 | A | * | 8/1980 | Brown | 40/110 |
| 4,358,906 | A | * | 11/1982 | Reininga | 40/107 |
| 4,393,611 | A | * | 7/1983 | Lane et al. | 40/107 |
| 4,472,892 | A | * | 9/1984 | Yang | 40/107 |
| 4,484,402 | A | * | 11/1984 | Kebe | 40/107 |
| 4,567,680 | A | * | 2/1986 | DePaolo, Sr. | 40/109 |
| 4,934,076 | A | * | 6/1990 | Fowler | 40/107 |
| 6,381,885 | B1 | * | 5/2002 | Ficco, Jr. | 283/2 |

FOREIGN PATENT DOCUMENTS

GB 2122793 * 1/1984

* cited by examiner

*Primary Examiner*—William Miller
*Assistant Examiner*—André L. Jackson
(74) *Attorney, Agent, or Firm*—Ezra Sutton

(57) ABSTRACT

A perpetual calendar display device for displaying the calendar date. The perpetual calendar display device includes a calendar housing having a front wall, a rear wall, a top wall, a bottom wall and side walls for forming a first interior compartment. The front wall includes eight (8) elongated vertical spaced-apart strips each having side edges for forming seven (7) elongated vertical spaced-apart display openings. The first interior compartment having mounted therein seven spaced-apart rotatable columns. Each of the rotatable columns includes six (6) vertically spaced-apart display areas, and each of the display areas having up to seven (7) display positions forming a total of at least thirty-seven (37) display positions. Each of the thirty-seven (37) display positions having a number thereon corresponding to the date of a selected month; and the of the thirty-seven (37) display positions being movable into or out of display openings for displaying all of the dates for the selected month. Each of the display windows are for receiving one of the display positions for displaying one of the dates of the selected month.

23 Claims, 7 Drawing Sheets

PERPETUAL CALENDAR WALL DISPLAY DEVICE HAVING ROTATABLE CALENDAR DAYS

FIELD OF INVENTION

The present invention relates to a perpetual calendar display device for displaying all of the dates for each week of a selected month of a given calendar year. More particularly, the perpetual calendar display device includes rotatable vertical columns such that when the user sets the first seven days within the calendar week, the next three weeks fall automatically into place. The user then turns the appropriate other remaining rotatable vertical columns for setting the last few days of a selected month.

BACKGROUND OF THE INVENTION

Perpetual calendars in various forms, such as mechanical and manual, have been provided, but many are confusing to those users who find it difficult to remember the number of days which occur in each specific month for a given calendar year. Typically, perpetual calendar devices usually include a viewing window or area through which 42 day spaces may be viewed and a portion of the calendar disposed behind the viewing window has 57 month day indicia thereon arranged in serial arrangements repetitively in coordinates of seven and the aforementioned calendar portion is shiftable relative to the window in order that the desired total number of month days may be registered with the viewing window. The shiftable calendar portion must be adjusted to a particular position for each month in order that the first day of the month may start on the correct day of the week and after once being correctly adjusted, the day numbers of that month each are correctly positioned according to the days of the week. However, inasmuch as some months have 28, 29, 30 or 31 days, the month day numerals must include as many as 31 month day numerals registered with the aforementioned window and if that month has only 28, 29 or 30 days, the calendar is incorrect at the end of the month indicating at least one extra day in the month causing some persons to be confused by the extra day or a plurality of extra days when trying to rearrange the perpetual calendar display by the user.

There remains a need for a perpetual calendar device which may be properly set according to the number of days in a selected month being independent of whether that selected month includes 28, 29, 30 and 31 days. Further, the perpetual calendar display device will display all of the dates for each week of a selected month of a given calendar year. Additionally, the perpetual calendar display device will include seven rotatable vertical columns such that when a user sets the first seven days within the calendar week, the next three weeks fall automatically into place, where then the user turns the appropriate other remaining rotatable vertical columns for setting the last few days of that selected month.

DESCRIPTION OF PRIOR ART

Perpetual calendars, mechanical calendars, desk calendars and multi-year calendar devices of various designs, configurations, structures and materials of construction have been disclosed in the prior art. For example, U.S. Pat. No. 3,604,135 to ROBINSON discloses a mechanical calendar for indicating the day of the week on which a date in any month in a year falls. Symbols for indicating the year numeral, the date numeral, the days of the week and months of the year being arranged on peripheries of annular gears which can be selectively interconnected by gearing mounted in a movable cradle. The cradle is moved so that the gearing selectively engages the year numeral annual gears and the date data annular gear such that when the gearing rotated by a person operating the calendar to change the year numeral to a desired year the date data displayed is simultaneously altered. The cradle is then further moved by the operator to bring the gearing into selective engagement with the months annular gear and the days of the week annular gear so that by further rotation of the gearing to bring the desired month into display the day of the week data displayed is also simultaneously altered. This prior art patent does not disclose or teach a manually operated perpetual calendar wall display device having the configuration, design and structure of the present invention.

U.S. Pat. No. 3,930,326 to ROSA discloses a desk calendar which permits the day, date and year to be changed by the simple manipulation of two dials, having, internally, a first and second shaft, each shaft controlling two rotatable drums. Each shaft has disposed thereon a first and second actuating member for operative engagement with a coupling device such that when the dialing member is turned in one direction the first drum will rotate and when the dial member is turned in the opposite direction the second drum will rotate. The same structure is related to the second shaft which is disposed on the other end of the frame having a separate dialing member associated therewith. This prior art patent does not disclose or teach a manually operated perpetual calendar wall display device having the configuration, design and structure of the present invention.

U.S. Pat. No. 4,376,346 to NELSON discloses a cylindrical perpetual calendar. The calendar may be adjusted in order that each month displayed by the calendar will have only the correct number of month days indicated thereby, as shown in FIGS. 1 and 3. The perpetual calendar may be constructed in various forms, but the preferred form is that of a cylindrical member whose interior may be utilized for storage of various items. This prior art patent does not disclose or teach a manually operated perpetual calendar wall display device having the configuration, design and structure of the present invention.

U.S. Pat. No. 4,484,402 to KEBE discloses a perpetual calendar possessing the ability to display any date, past, present or future, in a finite range, and the day of the week for that particular date without prior knowledge or calculation. The perpetual calendar includes individually gear driven indicia belts for composing month and year dates and another indicia belt which is simultaneously gear driven with the movement of any one of the aforesaid individually gear driven indicia belts is shiftable into driving engagement with a selected indicia belt by linear movement of a sliding indicator on the top panel of the calendar housing. The drive shaft for the single shiftable drive gear is turned by an external knob on one side of the calendar housing. This prior art patent does not disclose or teach a manually operated perpetual calendar wall display device having the configuration, design and structure of the present invention.

U.S. Pat. No. 5,657,561 to ZYKOV discloses a multi-year calendar device, as shown in FIGS. 1 to 13 of the drawings. The calendar device includes a casing having a first window and a second window therethrough. A mechanism is for manually turning a continuous belt in the casing. A person operating the manually turning mechanism can align one year date on the continuous belt in the first window to one month name on the casing and then view the numerical month dates for that particular month of that particular year through the second window in the casing. This prior art patent does not disclose or teach a manually operated perpetual calendar wall display device having the configuration, design and structure of the present invention.

None of the aforementioned prior art patents disclose or teach the features, configuration and structure of the perpetual calendar display device having rotatable calendar dates for displaying a particular month of a given year by manual manipulation.

Accordingly, it is an object of the present invention to provide a perpetual calendar display device that is capable of displaying all of the dates for each week of a selected month of a given calendar year.

Another object of the present invention is to provide a perpetual calendar display device that uses seven rotatable vertical columns such that when the user sets the first seven days within the calendar week, the next three weeks fall automatically into place, when then the user now turns the appropriate other remaining rotatable vertical columns for setting the last few days of a selected month.

Another object of the present invention is to provide a perpetual calendar display device that needs to interchanging of numbers for the proper placement of the calendar dates for a selected month for a given year.

Another object of the present invention is to provide a perpetual calendar display device that includes a plurality of snap-in occasion pieces for further indicating important dates such as birthdays, holidays, anniversaries, medical visits, school events and sporting events.

Another object of the present invention is to provide a perpetual calendar display device that is easily operated by the simple manual manipulation of turning each of the rotatable vertical columns by a rubber-tipped number turner being operated by the user.

Another object of the present invention is to provide a perpetual calendar display device that is cleanable, durable being made of wood, plastic, ceramic or light-weight metals.

Another object of the present invention is to provide a perpetual calendar display device that can be used on a wall, or on a table, counter or desktop.

Another object of the present invention is to provide a perpetual calendar display device that can be mass produced in an automated and economical manner and is readily affordable by the consumer.

SUMMARY OF THE INVENTION

In accordance with the present invention, there is provided a perpetual calendar display device for displaying the calendar date. The perpetual calendar display device includes a calendar housing having a front wall, a rear wall, a top wall, a bottom wall and side walls for forming a first interior compartment. The front wall includes eight (8) elongated vertical spaced-apart strips each having side edges for forming seven (7) elongated vertical spaced-apart display openings. The first interior compartment having mounted therein seven spaced-apart rotatable columns. Each of the rotatable columns includes six (6) vertically spaced-apart display areas, and each of the display areas having up to seven (7) display positions forming a total of at least thirty-seven (37) display positions. Each of the thirty-seven (37) display positions having a number thereon corresponding to the date of a selected month; and the thirty-seven (37) display positions being movable into and out of the display openings for displaying all of the dates for the selected month. Each of the display windows are for receiving one of the display positions for displaying one of the dates of the selected month.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENTS

Overview

Figure 1:
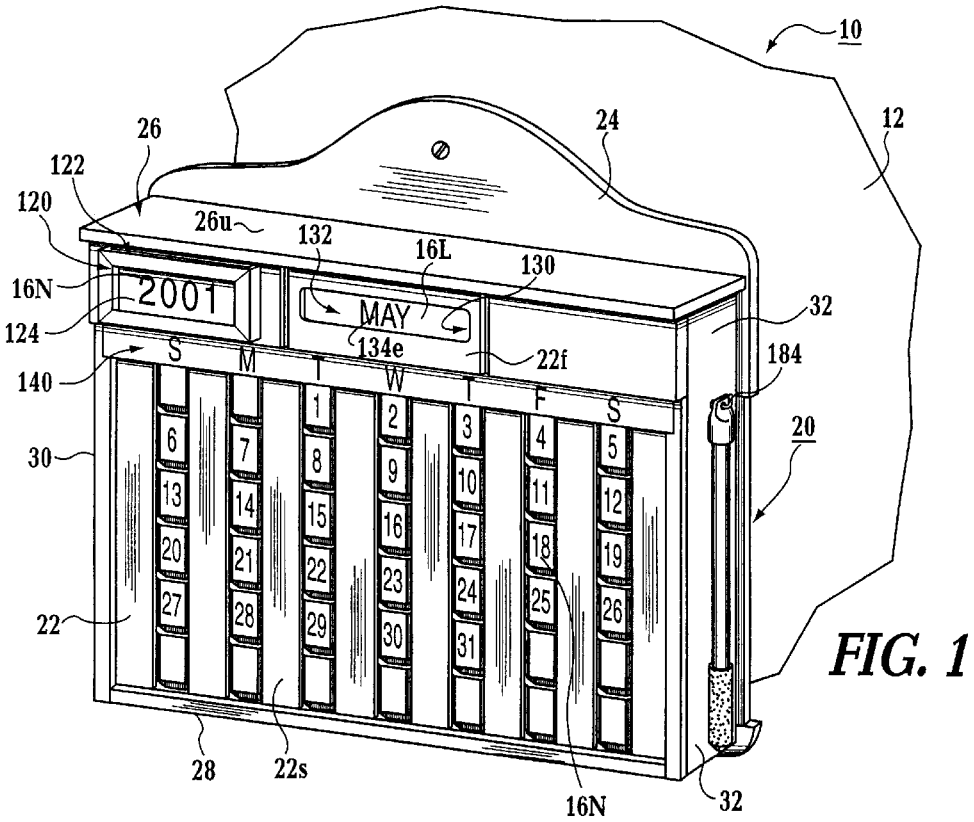
FIG. 1 is a front perspective view of the perpetual calendar display device of the preferred embodiment of the present invention showing the major component parts contained therein and in operational use thereof.
Figure 4:
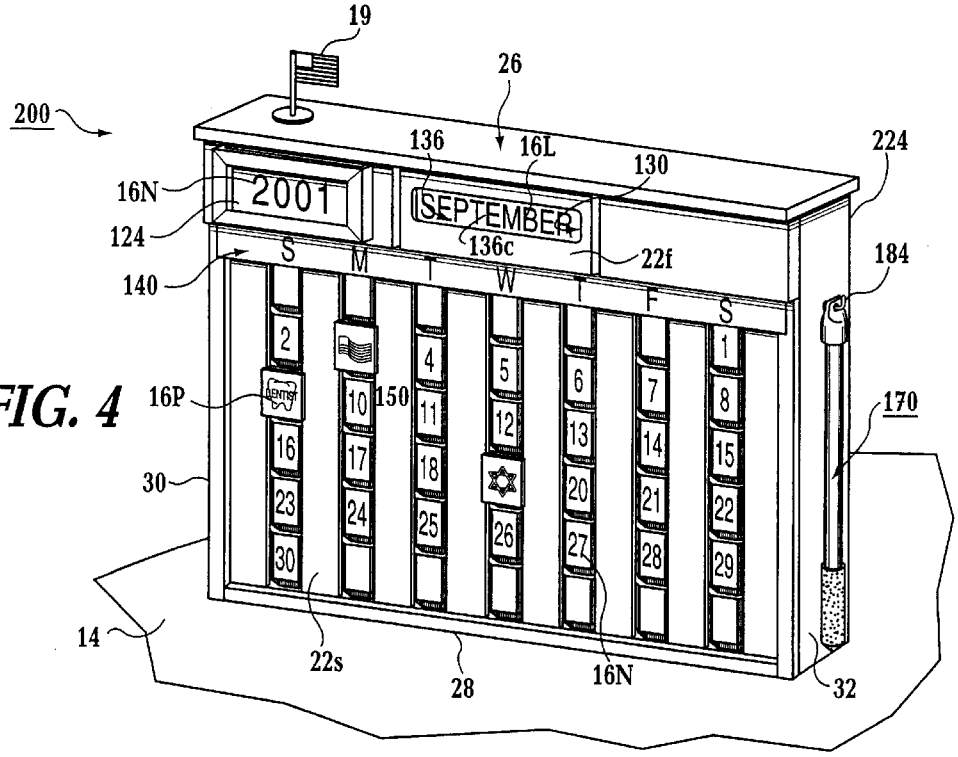
FIG. 4 is a front perspective view of the perpetual calendar display device of an alternate embodiment of the present invention showing the front wall having seven display openings therein, the seven vertical rotatable columns having numerical indicia thereon, a plurality of occasion pieces positioned within the display openings, the calendar month window opening and the calendar year display frame thereon.

The perpetual calendar display devices 10 and 200 and its component parts of the preferred and alternate embodiments of the present invention are represented in detail by FIGS. 1 through 18 of the patent drawings. The perpetual calendar display devices 10 and 200 are used to display all of the dates for each week of a selected month of a given calendar year, as depicted in FIGS. 1 and 4 of the drawings. The perpetual calendar display device 10 can be used on a wall 12, as shown in FIG. 1, whereas the perpetual calendar display device 200 can be used on a table top 14, counter top, desk top, mantle and the like, as shown in FIG. 4. The perpetual calendar display device 10 and 200 can be made from materials such as wood, plastic, ceramic or light-weight metals. The perpetual calendar display devices 10 or 200 can be made into various geometrical or simple curvilinear configurations, as shown in FIGS. 1 and 4 of the drawings.

Preferred Embodiment 10

Figure 2:
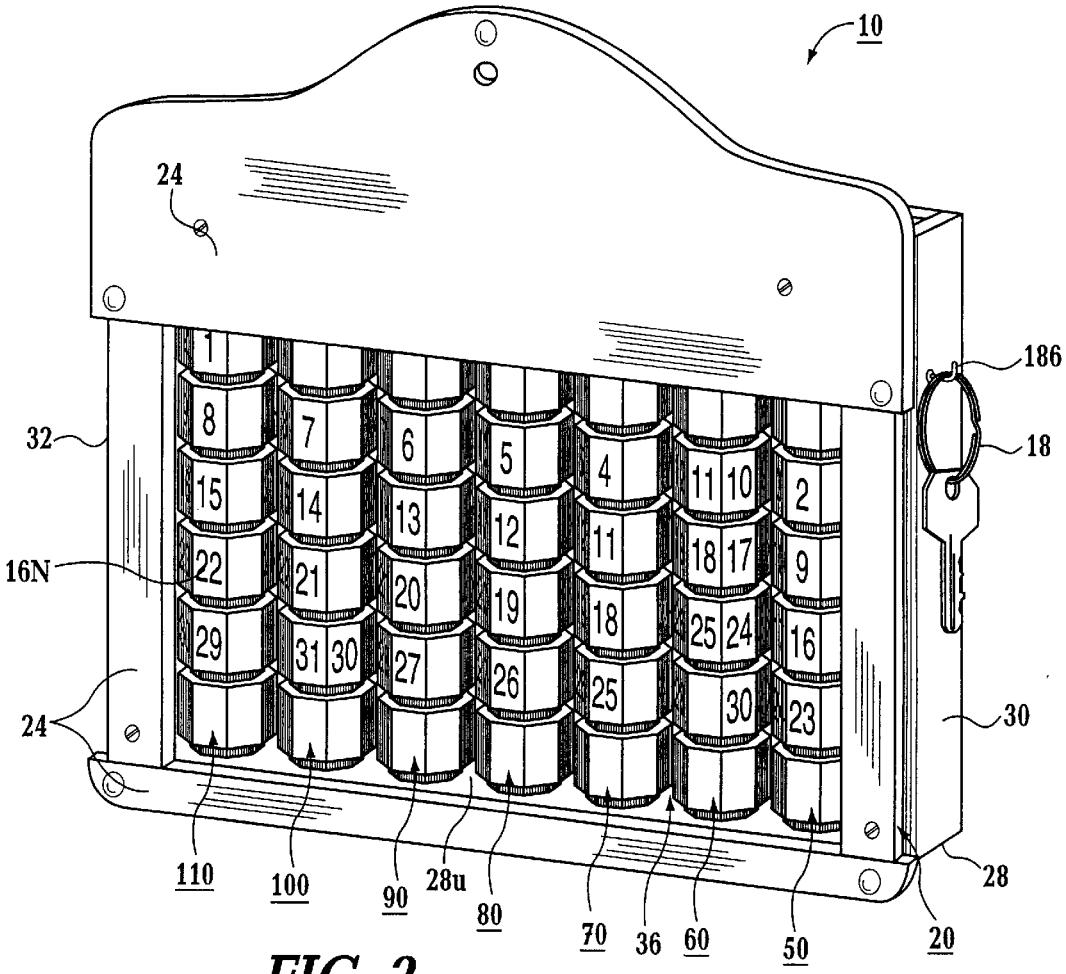
FIG. 2 is a rear perspective view of the perpetual calendar display device of the preferred embodiment of the present invention showing the first interior compartment having the seven rotatable columns therein.
Figure 5:
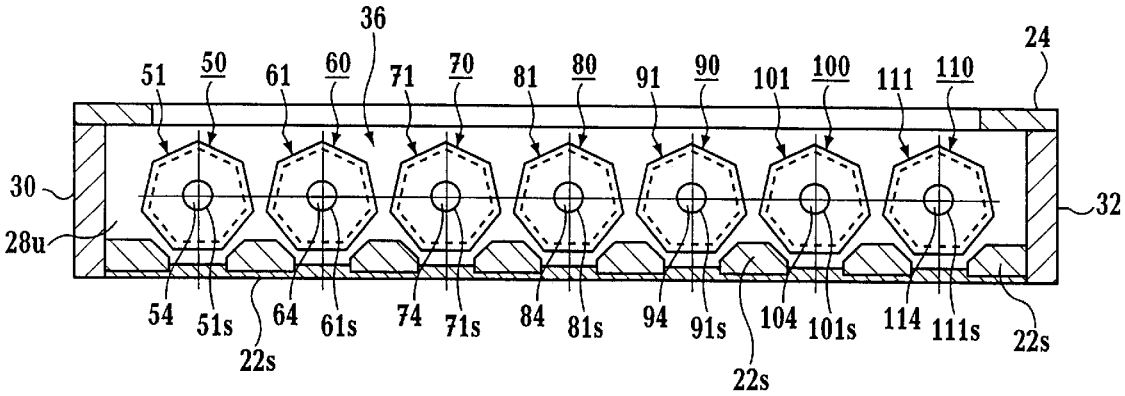
FIG. 5 is a top cross-sectional view of the perpetual calendar display device of the present invention taken along lines 5—5 of FIG. 4 showing the front wall having a plurality of vertical strips for defining the seven display openings, the side walls, the seven octagonally shaped vertical rotatable columns have a center shaft opening for receiving a shaft.
Figure 3A:
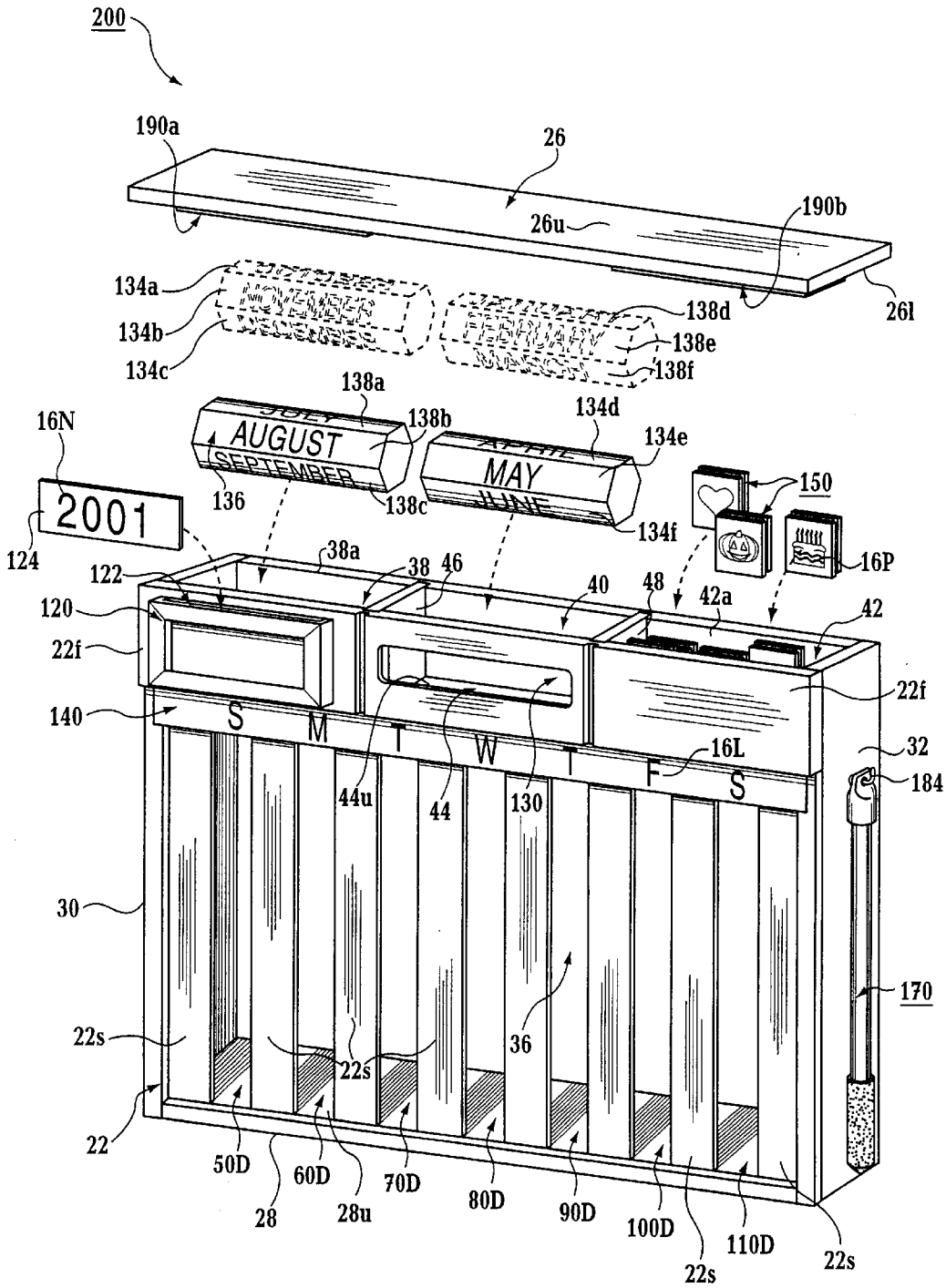
FIG. 3A is an exploded front perspective view of the perpetual calendar display device of the alternate embodiment of the present invention showing the major component parts contained therein.
Figure 3B:
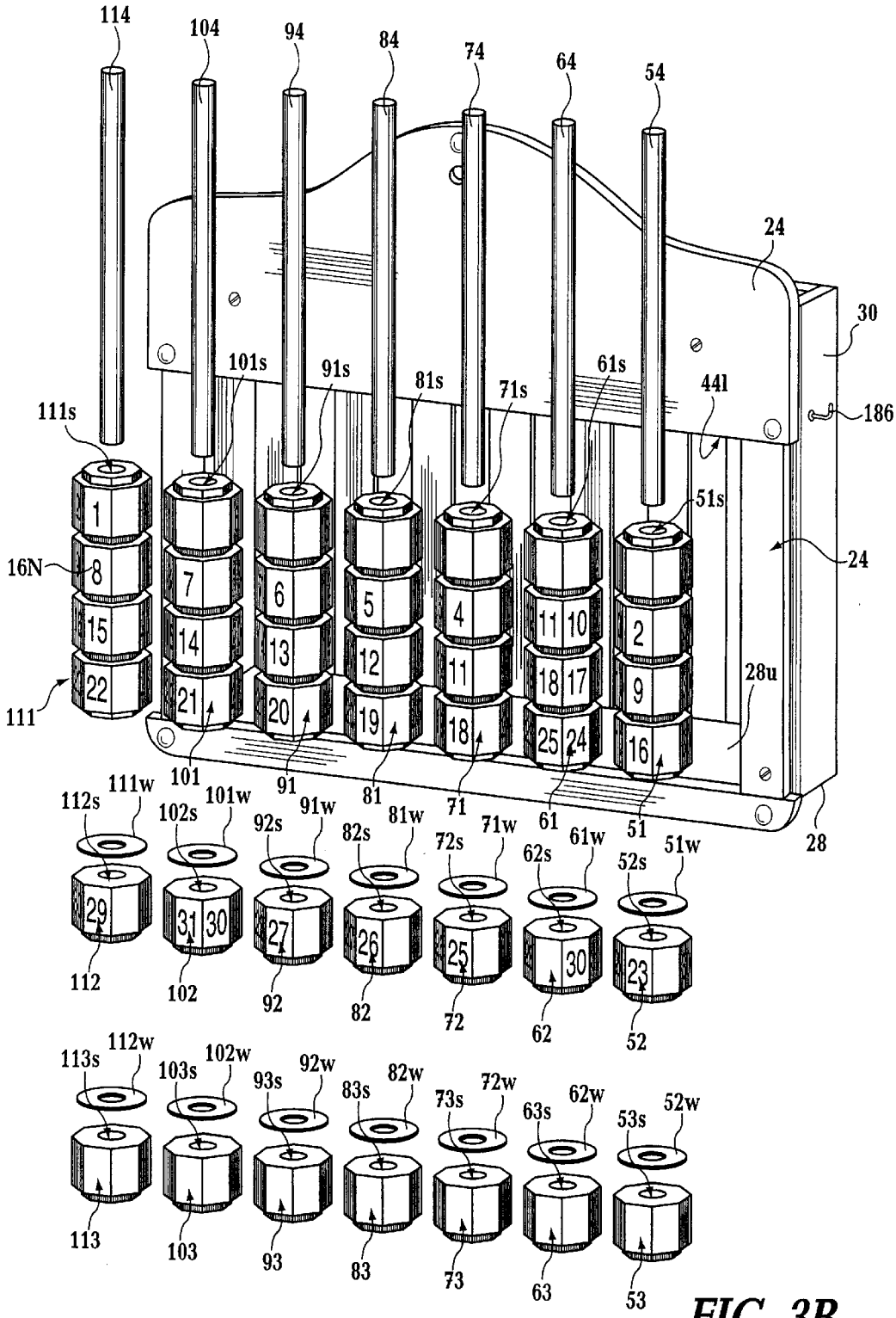
FIG. 3B is an exploded rear perspective view of the perpetual calendar display device of the preferred embodiment of the present invention showing the major component parts contained therein.
Figure 6:
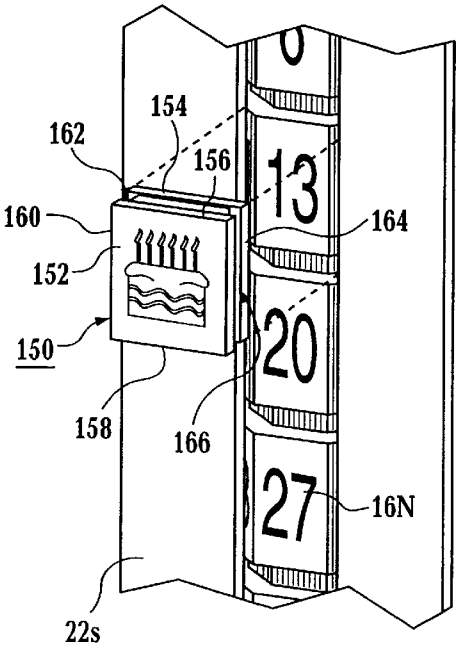
FIG. 6 is an enlarged perspective view of the perpetual calendar display device of the present invention showing the placement of an occasion piece within a section of the display opening.
Figure 9:
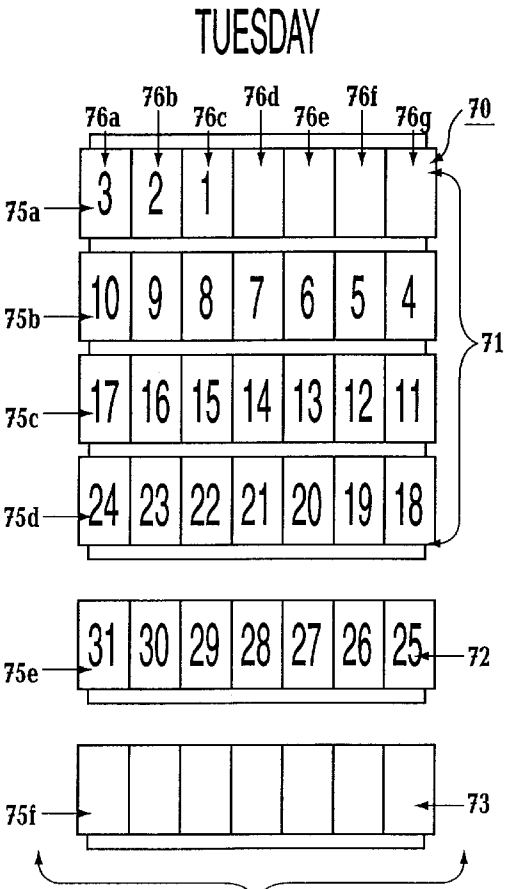
FIG. 9 is a developed elevational view of the perpetual calendar display device of the present invention showing the numerical indicia displayed on the plurality of display positions representing the third vertical rotatable column.
Figure 8:
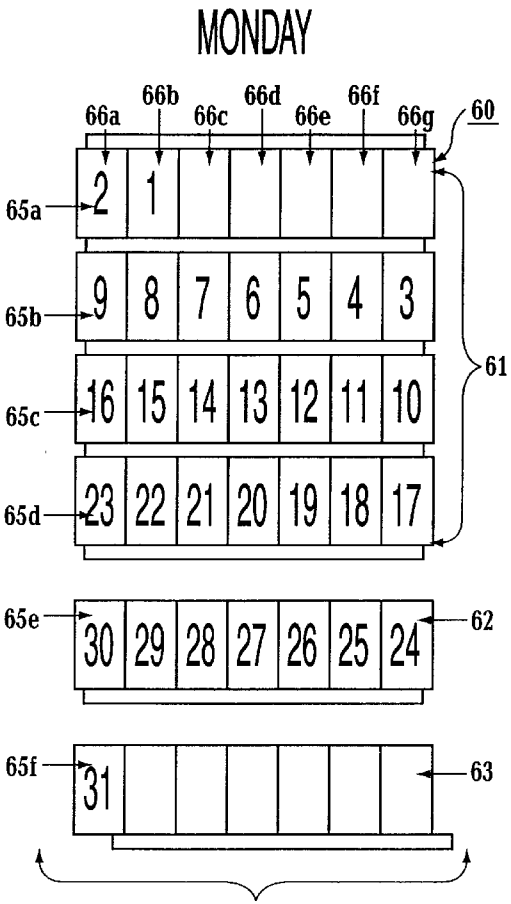
FIG. 8 is a developed elevational view of the perpetual calendar display device of the present invention showing the numerical indicia displayed on the plurality of display positions representing the second vertical rotatable column.
Figure 7:
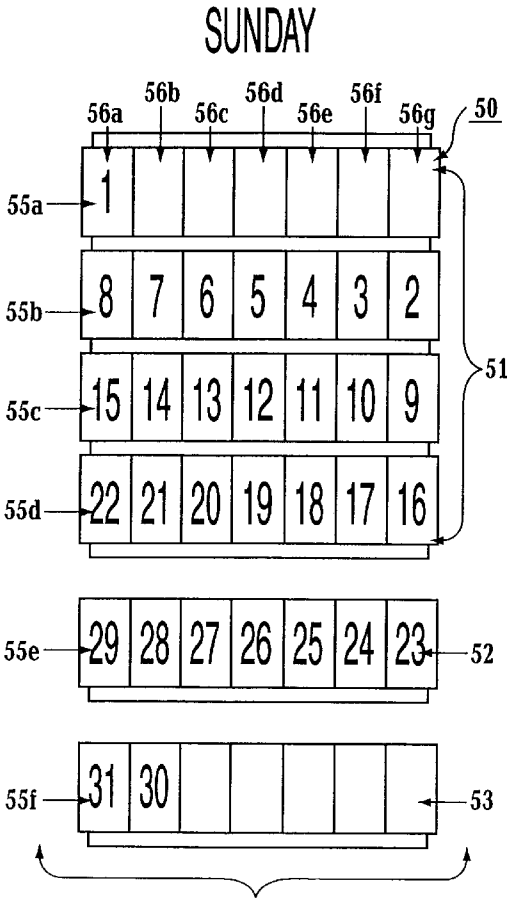
FIG. 7 is a developed elevational view of the perpetual calendar display device of the present invention showing the numerical indicia displayed on the plurality of display positions representing the first vertical rotatable column.

The perpetual calendar display device 10 and its component parts of the preferred embodiment of the present invention are represented in detail by FIGS. 1 to 3 and 5 to 18 of the patent drawings. The perpetual calendar display device 10 includes a calendar housing 20 being substantially rectangularly-shaped having a front wall 22, a rear wall 24, a detachably top wall 26, a bottom wall 28 and a side walls 30 and 32 forming a large first interior compartment 36, a second interior compartment 38, a third interior compartment 40, and a fourth interior compartment 42. The first interior compartment 36 includes a top interior wall 44 having an upper interior top wall surface 44*u* and a lower interior top wall surface 44*l*. Top interior wall 44 separates the first interior compartment 36 from the second, third and fourth interior compartments 38, 40 and 42, respectively, as shown in FIGS. 2, 3A and 3B of the drawings. Interior compartments 38, 40 and 42 have equally spaced-apart interior compartment walls 46 and 48 for separating each of the second, third and fourth interior compartments 38, 40 and 42 as shown in FIG. 6 of the drawings. The bottom wall 28 includes an upper bottom wall surface 28*u*.

The front wall 22 includes a plurality of eight (8) elongated vertical strips 22s being equally spaced-apart, each of the vertical strip 22 having side edges 22*e* thereon. The eight (8) vertical strips 22*s* on front wall 22 are used for forming seven (7) elongated vertical equally spaced-apart display openings 50D, 60D, 70D, 80D, 90D, 100D and 110D. Front wall 22 also includes an upper front wall section area 22*f*.

Figure 11:
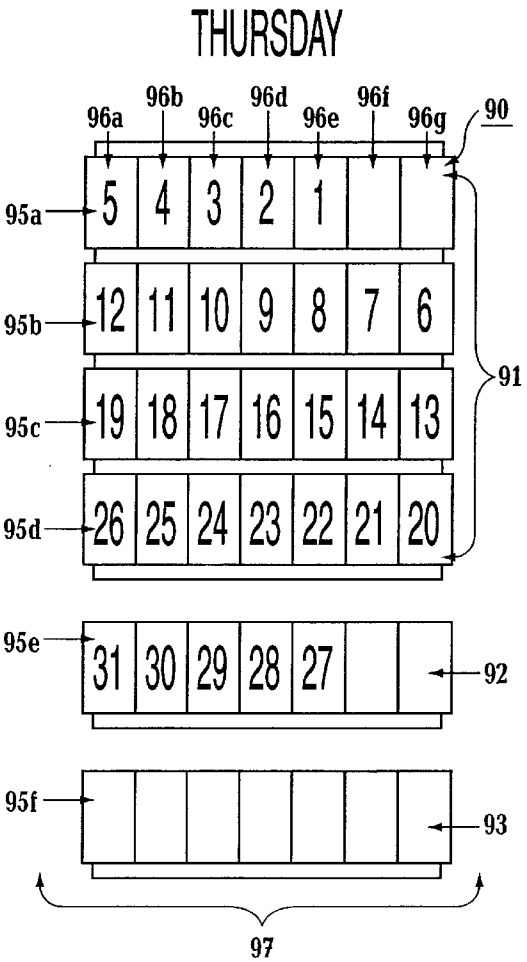
FIG. 11 is a developed elevational view of the perpetual calendar display device of the present invention showing the numerical indicia displayed on the plurality of display positions representing the fifth vertical rotatable column.

The first interior compartment 36 includes seven (7) equally spaced-apart rotatable vertical columns 50, 60, 70, 80, 90, 100 and 110 being mounted thereon. The rotatable vertical columns 50 to 110 can be octagonally-spaced (8 sided) (See FIG. 3B) having 48 display spaces thereon for numerical indicia 16N or can be heptagonally-shaped (7 sides) having 42 display spaces thereon for numerical indicia 16N, as shown in FIG. 5. The first rotatable vertical column 50 includes a first column section 51 having first column section shaft opening 51*s* therein, a second column section 52 having a second column section shaft opening 52*s* therein and a third column section 53 having a third column section shaft opening 53*s* therein, as shown in FIGS. 2 and 3B of the drawings. Each of the aligned shaft openings 51*s*, 52*s* and 53*s* are used for receiving a vertical stationary shaft 54 therein. Each column section 51, 52 and 53 is separated by a teflon or plastic column washer 51*w* and 52*w*, respectively. The rotatable vertical column 50 further includes six (6) vertical spaced-apart display areas 55*a* to 55*f* having at least seven (7) display positions 56*a* to 56*g*, respectively, for forming a total of at least forty-two (42) display positions 57, as depicted in FIG. 11 of the drawings. The first column section 51 includes four of the six display areas 55*a*, 55*b*, 55*c*, and 55*d* being movable as a unit relative to the remaining two display areas 55*e* and 55*f* on the second and third column sections 52 and 53, respectively, of the first vertical rotatable column 50. The remaining two display areas 55*e* and 55*f* of the second and third column sections 52 and 53 are moveable as a single unit relative to each other.

Figure 12:
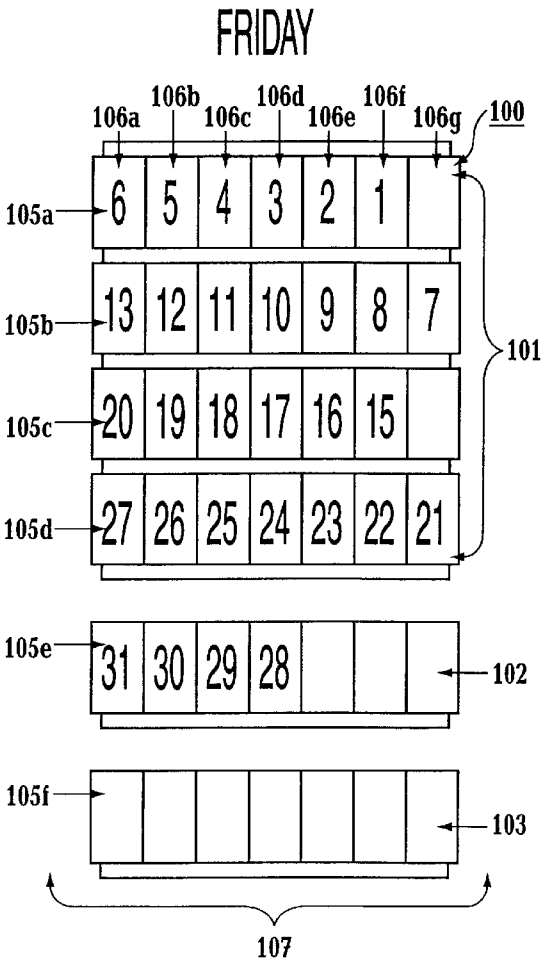
FIG. 12 is a developed elevational view of the perpetual calendar display device of the present invention showing the numerical indicia displayed on the plurality of display positions representing the sixth vertical rotatable column.

The second rotatable vertical column 60 includes a first column section 61 having a first column section shaft opening 61*s* therein, a second column section 62 having a second column section shaft opening 62*s* therein, and a third column section 63 having a third column section shaft opening 63*s* therein, as shown in FIGS. 2 and 3B of the drawings. Each of the aligned shaft openings 61S, 62S and 63S are used for receiving a vertical stationary shaft 64 therein. Each column section 61, 62 and 63 is separated by a teflon or plastic column washer 61*w* and 62*w*, respectively. The rotatable vertical column 60 further includes six (6) vertical spaced-apart display areas 65*a* to 65*f* having at least seven (7) display positions 66*a* to 66*g*, respectively, for forming a total of at least forty-two (42) display positions 67, as depicted in FIG. 12 of the drawings. The first column section 61 includes four of the six display areas 65*a*, 65*b*, 65*c* and 65*d* being movable as a unit relative to the remaining two display areas 65*e* and 65*f* on the second and third column sections 62 and 63, respectively, of the second vertical rotatable column 60. The remaining two display areas 65*e* and 65*f* of the second and third column sections 62 and 63 are moveable as a single unit relative to each other.

Figure 13:
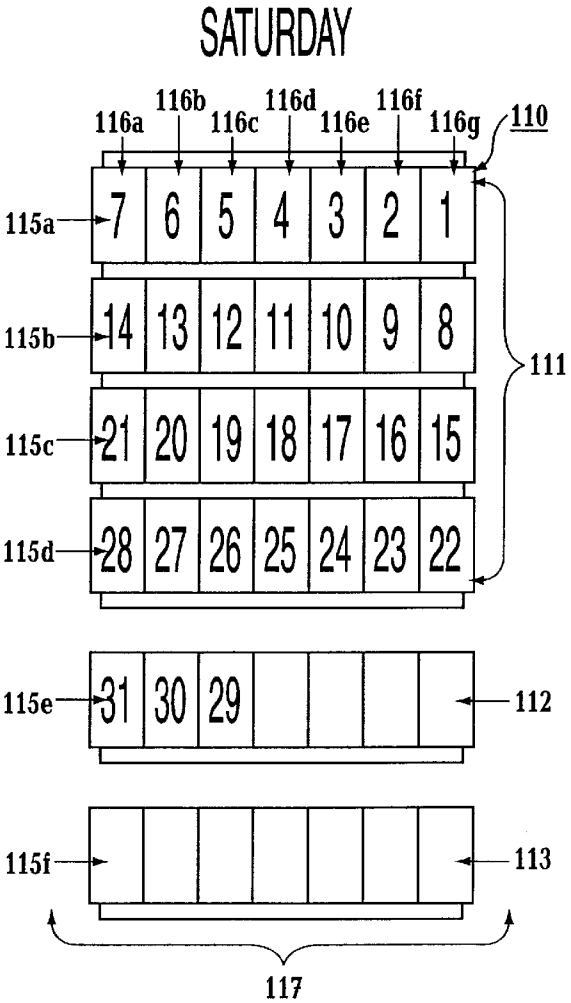
FIG. 13 is a developed elevational view of the perpetual calendar display device of the present invention showing the numerical indicia displayed on the plurality of display positions representing the seventh vertical rotatable column.

The third rotatable vertical column 70 includes a first column section 71 having a first column section shaft opening 71S therein, a second column section 72 having a second column section shaft opening 72*s* therein, and a third column section 73 having a third column section shaft opening 73*s* therein, as shown in FIGS. 2 and 3B of the drawings. Each of the aligned shaft openings 71*s*, 72*s* and 73*s* are used for receiving a vertical stationary shaft 74 therein. Each column section 71, 72 and 73 is separated by a teflon or plastic column washer 71*w* and 72*w*, respectively. The rotatable vertical column 70 further includes six (6) vertical spaced-apart display areas 75*a* to 75*f* having at least (7) display positions 76*a* to 76*g*, respectively, for forming a total of at least forty-two (42) display positions 77, as depicted in FIG. 13 of the drawings. The first column section 71 includes four of the six display areas 75*a*, 75*b*, 75*c* and 75*d* being movable as a unit relative to the remaining two display areas 75*e* and 75*f* on the second and third column sections 72 and 73, respectively, of the third vertical rotatable column 70. The remaining two display areas 75*e* and

75*f* of the second and third column sections 72 and 73 are moveable as a simple unit relative to each other.

Figure 14:
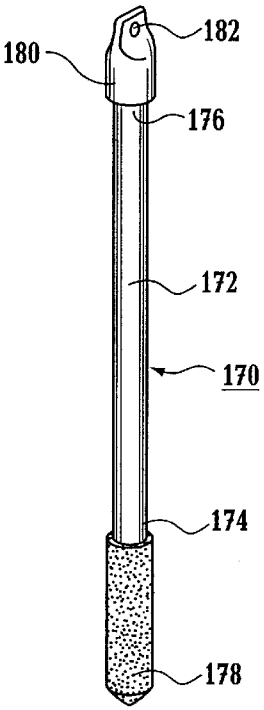
FIG. 14 is a front perspective view of the perpetual calendar display device of the present invention showing a rubber-tipped number turner.

The fourth rotatable vertical column 80 includes a first column section 81 having a first column section shaft opening 81*s* therein, a second column section 82 having a second column section shaft opening 82*s* therein, and a third column section 83 having a third column section shaft opening 83*s* therein, as shown in FIGS. 2 and 3B of the drawings. Each of the aligned shaft opening 81*s*, 82*s* and 83*s* are used for receiving a vertical stationary shaft 84 therein. Each column section 81, 82 and 83 is separated by a teflon or plastic column washer 81*w* and 82*w*, respectively. The rotatable vertical column 80 further includes six (6) vertical spaced-apart display areas 85*a* to 85*f* having at least seven (7) display positions 86*a* to 86*g*, respectively, for forming a total of at least forty-two (42) display positions 87, as depicted in FIG. 14 of the drawings. The first column section 81 includes four of the six display areas 85*a*, 85*b*, 85*e* and 85*d* being movable as a unit relative to the remaining two display areas 85*e* and 85*f* on the second and third column sections 82 and 83, respectively, of the fourth vertical rotatable column 80. The remaining two display areas 85*e* and 85*f* of the second and third column sections 82 and 83 are moveable as a single unit relative to each other.

The fifth rotatable vertical column 90 includes a first column section 91 having a first column section shaft opening 91*s* therein, a second column section 92 having a second column section shaft opening 92*s* therein, and a third column section 93 having a third column section shaft opening 93*s* therein, as shown in FIGS. 2 and 3B of the drawings. Each of the aligned shaft openings 91*s*, 92*s* and 93*s* are used for receiving a vertical stationary shaft 94 therein. Each column section 91, 92 and 93 is separated by a teflon or plastic column washer 91*w* and 92*w*, respectively. The rotatable vertical column 90 further includes six (6) vertical spaced-apart display areas 95*a* to 95*f* having at least seven (7) display positions 96*a* to 96*g*, respectively, for forming a total of at least forty-two (42) display positions 97, as depicted in FIG. 15 of the drawings. The first column section 91 includes four of the six display areas 95*a*, 95*b*, 95*c* and 95*d* being movable as a unit relative to the remaining two display areas 95*e* and 95*f* on the second and third column sections 92 and 93, respectively, of the fifth vertical rotatable column 90. The remaining two display areas 95*e* and 95*f* of the second and third column sections 92 and 93 are moveable as a single unit relative to each other.

The sixth rotatable vertical column 100 includes a first column section 101 having a first column section shaft opening 101*s* therein, a second column section 102 having a second column second shaft opening 102*s* therein, and a third column section 103*s* therein, as shown in FIGS. 2 and 3B of the drawings. Each of the aligned shaft openings 101S, 102S and 103S are used for receiving a vertical stationary shaft 104 therein. Each column section 101, 102 and 103 is separated by a teflon or plastic column washer 101*w* and 102*w*, respectively. The rotatable vertical column 100 further includes six (6) vertical spaced-apart display areas 105*a* to 105*f* having at least seven (7) display positions 106*a* to 106*g*, respectively, for forming a total of at least forty-two (42) display positions 107, as depicted in FIG. 16 of the drawings. The first column section 101 includes four of the six display areas 105*a*, 105*b*, 105*e* and 105*d* being movable as a unit relative to the remaining two display areas 105*e* and 105*f* on the second and third column sections 102 and 103, respectively, of the sixth vertical rotatable column 100. The remaining two display areas 105*e* and 105*f* of the second and third column sections 102 and 103 are moveable as a single unit relative to each other.

The seventh rotatable vertical column 110 includes a first column section 111 having a first column section shaft opening 111*s* therein, a second column section 112 having a second column section shaft opening 112*s* therein, and a third column section 113 having a third column section shaft opening 113*s* therein, as shown in FIGS. 2 and 3B of the drawings. Each of the aligned shaft openings 111*s*, 112*s*, and 113*s* are used for receiving a vertical stationary shaft 114 therein. Each column section 111, 112 and 113 is separated by a teflon or plastic column washer 111*w* and 112*w*, respectively. The rotatable vertical column 110 further includes six (6) vertical spaced-apart display areas 115*a* to 115*f* having at least seven (7) display positions 116*a* to 116*g*, respectively, for forming a total of at least forty-two (42) display positions 117, as depicted in FIG. 17 of the drawings. The first column section 111 includes four of the six display areas 115*a*, 115*b*, 115*c* and 115*d* being movable as a unit relative to the remaining two display areas 115*e* and 115*f* on the second and third column sections 112 and 113, respectively, of the seventh vertical rotatable column 110. The remaining two display areas 115*e* and 115*f* of the second and third column sections 112 and 113 are moveable as a single unit relative to each other.

Each of the vertical stationary shafts are positioned and attached in equally spaced-apart locations between the lower interior top wall surface 48*i* of the interior top wall 48 and the upper bottom wall surface 28*u* of the bottom wall 28 as shown in FIG. 2 of the drawings. Front wall 22 also includes an upper front wall section area 22*f* having a rectangularly-shaped window frame display member 120 attached thereto. The window frame display member 120 includes an upper insert opening 122 therein for receiving a calendar year insert 124 therein with numerical indicia 16N thereon in the form of a specific year (i.e. 2001,2002, etc.), as shown in FIGS. 1, 3A and 4 of the drawings. The upper front wall section area 22*f* also includes a rectangularly-shaped window opening 130 for receiving either a first horizontal rotatable column 132 therein, or a second horizontal rotatable column 134, each horizontal rotatable column 132 and 134 being substantially hexagonally-shaped in configuration. The first horizontal rotatable column 132 includes six (6) display surfaces. 132*a* to 132*f* thereon, wherein each display surface 132*a* to 132*f* has the first six calendar months 16L thereon, separating January 134*a*, February 134*b*, March 134*c*, April 134*d*, May 134*e* and June 134*f*, as depicted in FIGS. 1 and 3A of the drawings. The second horizontal rotatable column 136 also includes six (6) display surfaces 138*a* to 138*f* thereon, wherein each display surface 138*a* to 138*f* has the second (remaining) six calendar months 16L thereon representing, July 138*a*, August 138*b*, Sep. 138*c*, October 138*d*, November 138*e* and December 138*f*, as depicted in FIGS. 3A and 4 of the drawings. The upper front wall section area 22*f* further includes a week display area 140 having equally spaced-apart days of the week 16L being aligned with the seven (7) elongated vertical spaced-apart display openings 50D, 60D, 70D, 80D, 90D, 100D and 110D, as shown in FIGS. 1 and 4 of the drawings.

Figure 10:
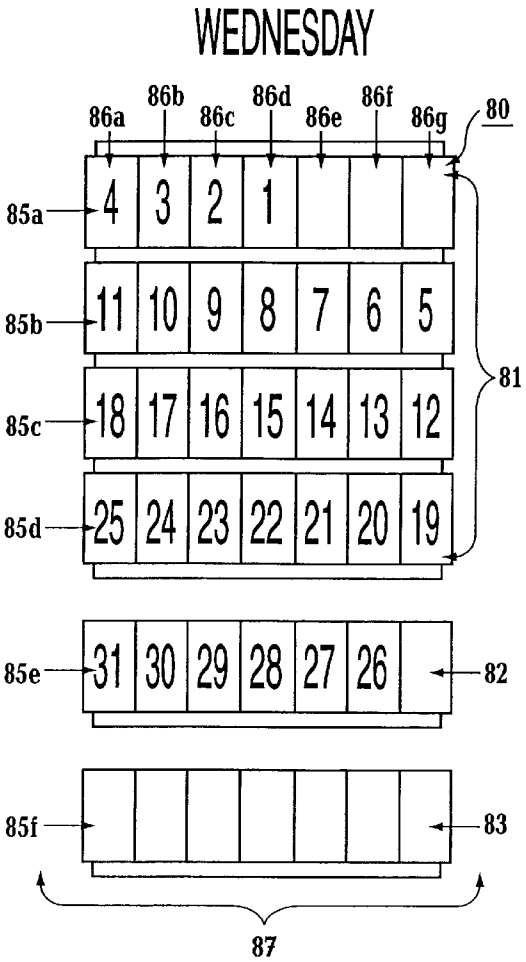
FIG. 10 is a developed elevational view of the perpetual calendar display device of the present invention showing the numerical indicia display on the plurality of display positions representing the fourth vertical rotatable column.

The perpetual calendar display device 10 or 200 as shown in FIG. 10, further includes a plurality of snap-in occasion pieces 150 for further indicating important dates such as birthdays, holidays, anniversaries, medical visits, school events and sporting events. Each snap-in occasion piece 150 includes a front wall surface 152, a rear wall surface 154, a top perimeter edge 156, a bottom perimeter edge 158, a first side perimeter edge 160 having a snap-in receiving channel 162 therein and a second side perimeter edge 164 having a snap-in receiving channel 166 therein. The front and rear wall surfaces 152 and 154 can have a pictorial indicia 16P thereon for indicating birthdays, holidays, anniversaries, medical visits, school events and sporting events. Each of the snap-in receiving channels 162 and 164 of the specific occasion piece 150 are attached to opposing vertical strips 22 of one of the display openings 50D, 60D, 70D, 80D, 90D, 100D or 110D, as depicted in FIGS. 4 and 10 of the drawings.

The perpetual calendar display device 10 or 200 also includes a rubber-tipped number turner 170 which is used for the manual manipulation of the rotatable vertical columns 50D and 110D in order to set the dates for each week of a selected month by spinning the rotatable vertical column to a particular position by the rubber-tipped pointer member 178, as shown in FIG. 14 of the drawings. The rubber-tipped number turner 170 includes a central shaft 172 having a first end 174 and a second end 176 thereon. The first end 174 includes an attached rubber-tipped pointer member 178 and the second end 176 includes a plastic hanger member 180 having a hook opening 182 therein. First side wall 30 includes a first hook member 184 for the hanging of key chains 18 and the like, and side wall 32 also includes a second hook member 186 for the hanging of the rubber-tipped member 170 via the hook opening 182 of the hanger member 180, as shown in FIG. 14 of the drawings.

Additionally, the detachable top wall 26 acts as a removable lid/cover for covering the second, third and fourth interior compartments 38, 40 and 42 of calendar display device 10 or 200, as depicted in FIG. 3A of the drawings. The detachable lid 26 includes an upper top wall surface 26*u* and a lower top wall surface 26*l*. The upper top wall surface 26*u* acts as a mantle for placing of knickknacks, ornaments, household articles 19 and the like thereon. The lower top wall surface 26*l* includes a pair of rectangularly-shaped connecting block inserts 190*a* and 190*b* for inserting into a second and fourth compartment openings 38*a* and 42*a* of the second and fourth interior compartments 38 and 42, respectively, in order to effectively close the lid 26 over the second, third and fourth interior compartments 38, 40 and 42 thereto, as depicted in FIGS. 3A of the drawings.

Alternate Embodiment 200

The perpetual calendar display device 200 and its component parts of the alternate embodiment of the present invention are represented in detail by FIG. 4 of the patent drawings. Perpetual calendar display device 200 is used for counter tops 14, table tops, desks and the like. All aspects of this alternate embodiment of the perpetual calendar display device 200 are exactly the same as the preferred embodiment of the perpetual calendar display device 10 except for the shape and configuration of rear wall 224 being different than rear wall 24, as shown in FIGS. 3A and 4 of the drawings.

Operation of the Present Invention

In operation, the perpetual calendar display device 10 and 200 of the preferred and alternate embodiments, as shown in FIGS. 1, 4 and 10 of the drawings, operate in the exact same manner. To operate the calendar display device 10 or 200 the user simply manipulates each of the rotatable vertical columns 50, 60, 70, 80, 90, 100 and 110 within their corresponding display openings 50D, 60D, 70D, 80D, 90D, 100D and 110D, respectively, by the turning of those rotatable vertical columns 50 to 110 by a rubber-tipped number turner 170 being operated by the user. For example, if the user wanted to select May, 2001 to be displayed on the calendar display device 10 or 200, the calendar display device operates in the following manner. The user initially rotates and sets the third rotatable vertical column 70, such that the first column section 71 displays the numerical indica 16N (1, 8, 15 and 22) on display areas 75*a*, 75*b*, 75*c*, and 75*d*, respectively. The user now rotates and sets the fourth rotatable vertical column 80, such that the first column section 81 displays the numerical indicia 16N (2,9,16 and 23) on display areas 85*a*, 85*b*, 85*c* and 85*d*, respectively. The user now rotates and sets the fifth rotatable vertical column 90, such that the first column section 91 displays the numerical indicia 16N (3, 10, 17 and 24) on display areas 95*a*, 95*b*, 95*c* and 95*d*, respectively. Next, the user now rotates and sets the sixth rotatable vertical column 100, such that the first column section 101 displays the numerical indicia 16N (4, 11, 18 and 25) on display areas 105*a*, 105*b*, 105*c* and 105*d*, respectively. The user now rotates and sets the seventh rotatable vertical column 110, such that the first column section 111 displays the numerical indicia 16N (5, 12, 19 and 26) on display areas 115*a*, 115*b*, 115*c* and 115*d*, respectively. In the next step, the user now rotates and sets the first rotatable vertical column 50, such that the first column section 51 displays a blank space and numerical indicia 16N (blank display space, 6, 13, and 20) on display areas 55*a*, 55*b*, 55*c* and 55*d*, respectively. The user now rotates and sets the second rotatable vertical column 60, such that the first column section 61 displays a blank space and numerical indica 16N (blank display space, 7, 14 and 21) on display areas 65*a*, 65*b*, 65*c* and 65*d*, respectively. The user now is able to rotate and set the second column section 52 of the first rotatable vertical column 50, such that the second column section 52 displays a single numerical indicia $\mathbf{16}N_1$ being the number "27" on display are 55*e*. The user again rotates and sets the second column sections 62, 72, 82 and 92 of the second, third, fourth and fifth rotatable vertical columns 60, 70, 80 and 90, respectively, for displaying a single numerical indicia $\mathbf{16}N_1$ being the numbers "28, 29, 30 and 31" on display areas 65*e*, 75*e*, 85*e* and 95*e*, respectively. The remaining second column sections 102 and 112 of the sixth and seventh rotatable vertical columns 100 and 110 leave the display areas 105*e* and 115*e* in a blank display mode. Further, the third column sections 53, 63, 73, 83, 93, 103 and 113 of the first through seventh vertical rotatable columns 50 to 110 are rotatably set to leave the display areas 55*f*, 65*f*, 75*f*, 85*f*, 95*f*, 105*f* and 115*f*, respectively, in a blank display mode, as depicted in FIGS. 7 to 13 of the drawings. These aforementioned operational steps have now set the calendar dates in their appropriate positions for displaying the month of May, 2001. This operation is repeated when the user sets the first seven days within a calendar week, the next three weeks fall automatically into place, where then the user turns the appropriate other remaining rotatable vertical columns for setting the last few days of any selected month.

Additionally, the user can also set various snap-in occasion pieces 150 within a specific date in a selected calendar month. For example, a holiday occasion piece 150 having a pictorial indicia 16P on its front or rear wall surface 152 or 154 (such as an Arm Forces insignia thereon) is placed on the numerical date of Monday, May 28, 2001. The snap-in occasion piece 150 is positioned over the display area 65*e* and set by placing the snap-in receiving channels 162 and 166 of occasion piece 150 within the side edges 22*e* of two opposing vertical strips 22*s* being within the second display opening 60D of the perpetual calendar display device 10 or 200, as shown in FIG. 10 of the drawings. In any given month, one or more occasion piece 150 can be set at various dates for that month to represent birthdays, holidays, anniversaries, medical visits, school and sporting events and the like.

Advantages of the Present Invention

Accordingly, an advantage of the present invention is that it provides for a perpetual calendar display device that is capable of displaying all of the dates for each week of a selected month of a given calendar year.

Another advantage of the present invention is that it provides for a perpetual calendar display device that uses seven rotatable vertical columns such that when the user sets the first seven days within the calendar week, the next three weeks fall automatically into place, when the user now turns the appropriate other remaining rotatable vertical columns for setting the last few days of a selected month.

Another advantage of the present invention is that is provides for a perpetual calendar display device that needs no interchanging of numbers for the proper placement of the calendar dates for a selected month for a given year.

Another advantage of the present invention is that it provides for perpetual calendar display device that includes a plurality of snap-in occasion pieces for further indicating important dates such as birthdays, holidays, anniversaries, medical visits, school events and sporting events.

Another advantage of the present invention is that it provides for a perpetual calendar display device that is easily operated by the simple manual manipulation of turning each of the rotatable vertical columns by a rubber-tipped number turner being operated by the user.

Another advantage of the present invention is that it provides for a perpetual calendar display device that is cleanable, durable being made from wood, plastic, ceramic or lightweight metals.

Another advantage of the present invention is that it provides for a perpetual calendar display device that can be used on a wall, or on a table, counter or desk-top.

A further advantage of the present invention is that it provides for perpetual calendar display device that can be mass produced in an automated and economical manner and is readily affordable by the consumer.

A latitude of modification, change, and substitution is intended in the forgoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A perpetual calendar display device for displaying a calendar date, comprising:

a) a calendar housing having a front wall, a rear wall, a top wall, a bottom wall and side walls for forming a first interior compartment;

b) said front wall including eight (8) elongated vertical spaced-apart strips each having side edges for forming seven (7) elongated vertical spaced-apart display windows;

c) said first interior compartment having mounted therein seven spaced-apart rotatable columns being rotatable without removing said rotatable columns from said calendar housing, each of said rotatable columns being rotatable relative to one of said display windows;

d) each of said rotatable columns having six (6) vertically spaced-apart display areas, and each of said display areas having at least (7) display positions forming a total of at least thirty-seven (37) display positions on each of said rotatable columns;

e) each of said thirty-seven (37) display positions having a number thereon corresponding to a date of a selected month; and f) said thirty-seven (37) display positions being movable into or out of said display windows for displaying all of said dates for said selected month.

2. A perpetual calendar display device in accordance with claim 1, wherein each of said display areas are for receiving one of said display positions for displaying one of the dates of the selected month.

3. A perpetual calendar display device in accordance with claim 1, wherein said calendar housing includes a prong wall having an upper section area thereon for displaying each day of the week.

4. A perpetual calendar display device in accordance with claim 1, wherein said top wall is removably detachable from said calendar housing.

5. A perpetual calendar display device in accordance with claim 1, wherein said front wall further includes a rectangularly shaped window frame display for receiving a calendar year insert therein.

6. A perpetual calendar display device in accordance with claim 1, wherein each of said rotatable columns having a substantially octagonally-shaped configuration or having a substantially heptagonally-shaped configuration.

7. A perpetual calendar display device in accordance with claim 1, wherein each of said rotatable columns having four of said six (6) display areas being movable as a unit relative to the remaining two of said display areas on each of said rotatable columns.

8. A perpetual calendar display device in accordance with claim 7, wherein each of said remaining two display areas on each of said rotatable columns being movable as a single unit relative to each other.

9. A perpetual calendar display device in accordance with claim 1, wherein said calendar housing further includes a second interior compartment, a third interior compartment and a fourth interior compartment.

10. A perpetual calendar display device in accordance with claim 9, wherein said third interior compartment having a removably mounted horizontal first hexagonally shaped rotatable column with six (6) display surfaces, wherein each of said display surfaces having the first six calendar months thereon.

11. A perpetual calendar display device in accordance with claim 9, wherein said fourth interior compartment having a removably mounted second horizontal hexagonally shaped rotatable column with six (6) display surfaces, wherein each of said display surfaces having the remaining six calendar months thereon.

12. A perpetual calendar display device in accordance with claim 9, wherein said second interior compartment for storing of said one or more occasion pieces when not in use on said at least thirty-seven (37) display positions.

13. A perpetual calendar display device in accordance with claim 1, wherein said front wall further includes a rectangularly shaped window opening.

14. A perpetual calendar display device in accordance with claim 13, wherein said window opening is for displaying one of said display surfaces having one of said first six calendar months thereon of said first horizontal rotatable columns.

15. A perpetual calendar display device in accordance with claim 13, wherein said window opening is for displaying one of said display surfaces having one of said remaining six calendar months thereon of said second horizontal rotatable column.

16. A perpetual calendar display device in accordance with claim 1, wherein one or more of said at least thirty-seven (37) display positions includes a snap-in occasions piece for removably mounting thereon.

17. A perpetual calendar display device in accordance with claim 16, wherein said snap-in occasions piece includes a front wall surface and side receiving channels.

18. A perpetual calendar display device in accordance with claim 17, wherein said front wall surface of said snap-in occasions piece include indicia for indicating birthdays, holidays, anniversaries, medical visits, and sporting events.

19. A perpetual calendar display device in accordance with claim 17, wherein said side receiving channels of said snap-in occasions piece are received within the adjacent side edges of said spaced-apart strips within said one or more of said at least thirty-seven (37) display positions.

20. A perpetual calendar display device in accordance with claim 1, wherein each of rotatable columns having a centrally located shaft opening for receiving a stationary shaft therein.

21. A perpetual calendar display device in accordance with claim 20, wherein each of said stationary shafts are positioned in a spaced-apart array within said first interior compartment of said calendar housing.

22. A perpetual calendar display device in accordance with claim 1, wherein said rotatable columns are positioned and moved by the use of a rubber tipped number turner.

23. A perpetual calendar display device in accordance with claim 22, wherein each of said side walls includes a hook for hanging keys and said rubber tipped number turner thereon.

* * * * *

UNITED STATES PATENT AND TRADEMARK OFFICE

CERTIFICATE OF CORRECTION

PATENT NO. : 6,550,165 B2
DATED : April 22, 2003
INVENTOR(S) : Charles Chirafesi, Jr.

It is certified that error appears in the above-identified patent and that said Letters Patent is hereby corrected as shown below:

Drawings,
FIG. 5, the rotatable columns should be "octagonally" shaped 8 spaces as shown in FIG. 3B.
FIG. 7-8-9-10-11-12-13, the six vertical spaced apart display areas should have 8 columns giving you a "octagonally" shape
FIG. 12, Friday, the number "14" is missing.

Signed and Sealed this

Twenty-fourth Day of August, 2004

JON W. DUDAS
*Director of the United States Patent and Trademark Office*